United States Patent [19]

Blackstone et al.

[11] Patent Number: 4,906,331

[45] Date of Patent: Mar. 6, 1990

[54] METHOD OF ENHANCING THE COOKING OF WOOD CHIPS FOR PULP PRODUCTION

[75] Inventors: Michael M. Blackstone, Savannah, Ga.; Cheng-I Chen; Thomas W. Woodward, both of Jacksonville, Fla.

[73] Assignee: Betz PaperChem, Inc., Jacksonville, Fla.

[21] Appl. No.: 185,352

[22] Filed: Apr. 12, 1988

Related U.S. Application Data

[63] Continuation of Ser. No. 65,103, Jun. 26, 1987, abandoned, which is a continuation of Ser. No. 745,759, Jun. 17, 1985, abandoned.

[51] Int. Cl.[4] ..... D21C 3/20

[52] U.S. Cl. ..... 162/72; 162/82

[58] Field of Search ..... 162/72, 82, 168.1, 164.1, 162/77

[56] References Cited

U.S. PATENT DOCUMENTS

| | | | |
|---|---|---|---|
| 2,716,058 | 8/1955 | Rapson et al. | 162/72 |
| 2,999,045 | 9/1961 | Mitchell et al. | 162/72 |
| 3,909,345 | 9/1975 | Parker et al. | 162/72 |
| 4,426,254 | 1/1984 | Wood et al. | 162/DIG. 3 |

OTHER PUBLICATIONS

Chem. Abstract; Rutkowski; *Inv. on the Role of Surface Active Agents on the Processes of Wood Pulping,* vol. 66, 1967, p. 9.

Chem. Abstract; Shpenzu et al.; *Wood Pulp Production;* vol. 98, 1983, p. 96.

Chem. Abst.; Kovalena et al.; *Composition of Desensitizing Paper Pulp;* vol. 102, 1985, p. 104.

Chem. Abst.; Streylyugina; *Effect of Surfactants on the Dispersibility of Cold—Refined Kraft paper;* vol. 91, 1979, p. 83.

Wenzyl, D. V. H., *Fatty Acid Dimethylamide Formulations as Production Additives in the Pulp Industry;* May 5, 1975.

Campos et al.; *Kraft Pulping is Improved by Utilizing Dimethylamides of Long Chain Fatty Acids;* Oct. 1973.

James P. Casey; Pulp and Paper Chemistry and Chemical Technology; 3rd ed., vol. 1, pp. 385, 390, 398, 404–406 & 412, (1980).

Chemical Abstract 104:151142q, "Pulping with an Amphoteric Surfactant Additive", (1986), vol. 104, p. 120.

Chemical Abstract 102:205630b, "Methods for control of pitch troubles in sulfate pulp mills", (1985), vol. 102, p. 90.

Chemical Abstract 101:173305k, "Reducing resing and fat content in kraft pulp", (1984), vol. 101, p. 112.

Chemical Abstract 100:141044n, "Bleaching of pulp using alkaline solutions . . . ", (1984), vol. 100, pp. 100–101.

Chemical Abstract 96:183008h, "Chlorination of pine kraft pulp . . . ", (1981).

K. E. Lowe et al., Paper Trade Journal, Sep. 29, 1969, pp. 40–42.

Chemical Abstract 91:22669f, "Colloidal—Chemical Properties . . . ", (1979), p. 113.

Chemical Abstract 89:148366q, "Production of Highly—Refined Pulp . . . ", (1978), vol. 89, p. 82.

Chemical Abstract 88:52195u, "Methods for the treatment of cord . . . ", (1978), vol. 88, pp. 75–76.

Chemical Abstract 87:25028z, "Effect of surfactant additives . . . ", (1977), vol. 87, p. 95.

Chemical Abstract 86:157305b, "Effect of surface—active agents . . . ", (1977), vol. 86, p. 100.

Chemical Abstract 82:60225e, "Application of unsaturated fatty acid . . . ", (1973).

Chemical Abstract 73:67828b, "Influence of surface—active agents . . . ", (1970).

Chemical Abstract 94:17330w, "Effect of surfactants on the surface . . . ", (1981), vol. 94, p. 89.

Chemical Abstract 82:158027s, "Adsorption of some surfactants by . . . ", (1975).

Chemical Abstract 93:27998p, "Addition of surfactants during hot . . . ", (1980), vol. 93, p. 88.

Chemical Abstract 92:95832j, "Effect of surfactants on the surface . . . ", (1980), vol. 92, p. 84.

Chemical Abstract 170394q, "Sorption of ionic surfactants by kraft . . . ", vol. 90, p. 104, (1979).

Chemical Abstract 90:1023364n, "Study of the effect of surfactants on some . . . ", (1979), vol. 90.

Chemical Abstract 90:40427j, "Study of the sorption—description of . . . ", (1979), vol. 90.

G. Bone Undergraduate Thesis Miami University (Ohio), May, 1977, pp. 1–40.

H. F. J. Wenzl, The Chemical Technology of Wood, Academic Press, New York, 1970, pp. 528–531, 652.

Encyclopedia of Chemical Technology, vol. 19, (John Wiley NY 1982), 379–391, 394–408, 417–419.

Encyclopedia of Polymer Science & Technology, vol. 15, pp. 32–34.

*Primary Examiner*—Virginia Manahoran

*Attorney, Agent, or Firm*—Alexander D. Ricci; Alex R. Sluzas

[57] ABSTRACT

The present invention is directed to the use of certain ethoxylated compounds to increase the yield of chemical pulping processes, the compound have the following structures:

$$HO(CH_2CH_2O)_a(\underset{\underset{CH_3}{|}}{CH}CH_2O)_b(CH_2CH_2O)_cH$$

These ethoxylated compounds have molecular weights of from about 500 to about 30,000 the ($CH_2CH_2O$) comprising from about 20 to 80 percent of the compound; and a, b, and c are each at least 1. The compounds are surface active agents which are added to the cooking liquor. The wood chips are cooked from about one-half and ten hours at a temperature of from about 200 and 500 degrees Fahrenhelt in a liquor including sodium hydroxide, sodium sulfide, and the surface active agent. The wood plug would have a reject level of at least 5% when the chips are cooked in the absence of the surface active agent. The process provides a simultaneous reduction in the level of rejects and an increased yield of pulp.

3 Claims, No Drawings

METHOD OF ENHANCING THE COOKING OF WOOD CHIPS FOR PULP PRODUCTION

This is a continuation of application Ser. No. 065,103 filed June 26, 1987, abandoned, which is a continuation of application Ser. No. 745,759 filed on June 17, 1985, abandoned.

BACKGROUND OF THE INVENTION

The present invention relates to the production of wood pulp by the sulfate pulp process. The technology and objectives of the present invention are described in detail in U.S. Pat. No. 3,909,345, the disclosure of which is incorporated in its entirety herein by reference.

The '345 patent discusses and claims the use of surface active agents having the general formula $$R[(C_2H_4O)_n(C_3H_6O)_m]_yH$$

as additives to sulfate cooking liquor aids for the purpose of obtaining higher yields of pulp from a given wood chip charge. The agents permit a greater effectiveness of the cooking process relative to chips which prior to that invention were considered rejects and not pulpable.

As the patent describes, wood chips derived primarily from coniferous (cypress, balsam, firs of various varieties, pines, etc.) are charged to a cooking vessel on a dry-weight basis and cooked for a predetermined time with a cooking liquor in a prescribed wood to liquor ratio (see Col. 2 of '345 patent). The cooking liquor is composed of various concentrations (depending on the wood comprising the chips and type pulp to be made) of sodium hydroxide and sodium sulfide.

The "cook" takes place at elevated pressures and temperatures (200°–500° F.) for periods ranging ½ to 10 hours.

THE PRESENT INVENTION

While there is a great deal of similarity between the invention of the earlier referred to patent and that of the present inventors, the similarities cease as regards to the type surface active utilized.

The present invention utilizes surface active agents having the general structure $$HO(CH_2CH_2O)_a(\underset{\underset{CH_3}{|}}{C}HCH_2O)_b(CH_2CH_2O)_cH$$

wherein a, b, and c are at least 1 but are such to produce an agent having a molecular weight of 500 to 30,000 with those having a molecular weight of 1,000 to 10,000 being preferred.

The present invention relates to improved process for cooking wood chips in a cooking liquor to form a Kraft pulp. The process comprises adding to the cooking liquor a surface active agent having the above formula and molecular weight and such that $(CH_2CH_2O)$ comprises from about 20 to 80 percent of the surface active agent, and cooking wood chips for from about one-half and ten hours at a temperature of from about 200 and 500 degrees Fahrenheit in a liquor including sodium hydroxide, sodium sulfide, and the surface active agent, i.e. Kraft pulping condition. The wood pulp employed in the process would have a reject level of at least 5% when the chips are cooked in the absence of the surface active agent. The process provides a simultaneous reduction in the level of rejects and an increased yield of pulp.

As with '345 patent, the present surface active agents or combination thereof may be added to the liquor prior to contact of such with the chips in an amount of 0.05 to 1% (pref. 0.1 to 0.5%) based upon the dry weight of the wood chips. The surface active agents used in accordance with the present invention are available from BASF Wyandotte Corp. under trade names such as Pluronic L-62, L-92 and F-108. The surface active agents have been found quite successful in cooking processes utilizing Southern Pine chips where a reject level (i.e., pulp cannot be produced from the chips) of 5% or higher (based on dry wood basis) is commonly experienced.

It was not until the present inventors again arrived at the concept of utilizing the technology in troublesome cooks that the benefits and advantages were experienced.

The present invention is particularly suitable in high yield pulp production (Kraft) utilizing Southern Pine chips. This unbleached pulp is commonly used to produce grocery sacks and liner board. From the available literature re the Pluronics, it was determined that L-62 had a molecular weight composed of approximately 20% $(CH_2CH_2O)$ and approximately 80%

$$(\underset{\underset{CH_3}{|}}{CH_2CH_2O})$$

and equaling approximately 2,188;

L-92 percentages were respectively about 20% and 80% with mw of 3,440;

and F-108 had percentages of 80% and 20% with a molecular weight of 16,250.

As earlier intimated, in chemical pulping, the cooking is usually terminated when the amount of rejects in the pulp is reduced to an acceptable level. Substantial yield and quality advantages can be obtained when chips are cooked to a higher liquid content. As a result, an increase in Kappa No. target by the use of thinner chips can achieve a substantial cost savings. However the thickness of chips produced on commercial scale is always quite variable, and a major portion of the total rejects frequently originate from a relatively small fraction of the chips having the greatest thickness.

The objective then of the present invention is to achieve a lower ratio of rejects by the addition of the subject surface active agents to the cooking liquor to enhance the uniform distribution of the cooking chemical and/or the removal of degraded materials from within the chips, resulting in lower rejects and higher yields.

EXPERIMENTAL

The following laboratory and mill studies and results demonstrate the effectiveness of certain surfactants and blends thereof as pulping additives to cooking liquor.

MILL STUDY

A product comprised on an active basis of an aqueous solution containing 10% Pluronic L-62 and 7½% Pluronic F-108 was tested. The mill produced Kraft pulp utilizing Southern Pine chips being cooked (pulped) at the following conditions Active Alkali = 15% as $Na_2O$ in cooking liquor Sulfidity=25% in cooking liquor Liquor/Wood Ratio=7/1 (oven-dried chip weight basis)

Cooking Temperature=170° C.

Time to 170° C.=90 minutes

Time at 170° C.=36 minutes

The procedure generally entails taking a sample of the wood chips to be cooked and oven drying such to determine its moisture content. The wood chips are fed to the cook (digester) on the basis of its dry weight. The wood chips are cooked with the liquor at the temperatures indicated in a closed vessel.

After the cook the pressure is released and the cooked pulp is screened and the percentage rejects determined (i.e., material retained on screen). Rejects percentage is determined by first drying the material retained on the screen and utilizing that weight in conjunction with the dry weight of chips added to establish the percentage of material rejected. Screened yield is determined in a like fashion.

The results of the mill study utilizing a dosage level of 0.10% product on oven-dried chip weight basis were as follows:

| Treatment | % Rejects | Kappa No.* |
|---|---|---|
| Untreated (Pretrial) | 12.4 | 92 |
| Treated | 8.3 | 92 |

*Indicates equivalent cooking conditions during both the pretrial and trial studies.

LABORATORY STUDIES

The condition and procedures (were laboratory modifiers) of the Kraft pulping process utilized in the foregoing mill study were repeated in the laboratory.

STUDY I: The pulping additive formulation was composed of an aqueous solution of 7.5% Pluronic L-62 and 7.5% Pluronic F-108.

Dosage Level=0.50% of formulation on oven-dried (O.D.) chip weight basis.

| Results | Screened Yield (% of OD Chips) | Rejects (% of OD Chips) |
|---|---|---|
| Untreated | 39.6 | 20.5 |
| Treated | 45.6 | 15.7 |

Study II:

Pulping Additive: 100% Pluronic L-92

Dosage Level: 0.075% 90D chip weight basis)

| Results | % Screened Yield As in Study I | % Rejects As In Study I |
|---|---|---|
| Untreated | 46.2 | 9.4 |
| Treated | 48.9 | 4.0 |

Whereas we have shown and described herein certain embodiments of the present invention, it is intended that there be covered as well any change or modification therein which may be made without departing from the spirit and scope of the invention.

What we claim is:

1. An improved process for cooking wood chips in a cooking liquor to form a Kraft pulp, the process comprising:

(a) adding to the cooking liquor a surface active agent having the formula $$HO(CH_2CH_2O)_a(\underset{\underset{CH_3}{|}}{CH}CH_2O)_b(CH_2CH_2O)_cH$$

wherein a, b, and c are each at least 1, the surface active agent having a molecular weight of from about 500 to about 30,000 and such that $(CH_2CH_2O)$ comprises from about 20 to 80 percent of the surface active agent; and (b) cooking wood chips for from about one-half and ten hours at a temperature of from about 200 and 500 degrees Fahrenheit in a liquor including sodium hydroxide, sodium sulfide, and the surface active agent the wood pulp having a reject level of at least 5% when the chips are cooked in the absence of the surface active agent, and the improved process providing a simultaneous reduction in the level of rejects and an increased yield of pulp.

2. A process according to claim 1 wherein the surface active agent is present in the liquor in an amount from about 0.05 and 1 percent of the dry weight of the chips.

3. A process according to claim 2 wherein the surface active agent is present in the liquor in an amount from about 0.1 to 0.5 percent of the dry weight of the chips.

* * * * *

UNITED STATES PATENT AND TRADEMARK OFFICE

CERTIFICATE OF CORRECTION

PATENT NO. : 4,906,331

DATED : March 6, 1990

INVENTOR(S) : Blackstone et al

It is certified that error appears in the above-identified patent and that said Letters Patent is hereby corrected as shown below:

Title page:

In Line 16 of the Abstract, please delete "plug" and substitute therefor --- pulp ---.

At Col. 2, Line 42, please delete "liquid" and substitute therefor --- lignin ---.

At Col. 4, line 2, please delete "90D" and substitute therefor --- on O.D.---

Signed and Sealed this

Fourteenth Day of May, 1991

*Attest:*

*Attesting Officer*

HARRY F. MANBECK, JR.

*Commissioner of Patents and Trademarks*